US005615797A

United States Patent [19]

Ripamonti

[11] Patent Number: 5,615,797

[45] Date of Patent: Apr. 1, 1997

[54] INSERT FOR A RUBBISH BIN

[75] Inventor: Mario B. Ripamonti, Brisbane, Australia

[73] Assignee: Otto Plastics Pty. Ltd., Queensland, Australia

[21] Appl. No.: 578,670

[22] PCT Filed: Jan. 5, 1994

[86] PCT No.: PCT/AU94/00007

§ 371 Date: Jan. 19, 1996

§ 102(e) Date: Jan. 19, 1996

[87] PCT Pub. No.: WO95/03238

PCT Pub. Date: Feb. 2, 1995

[30] Foreign Application Priority Data

Jul. 20, 1993 [AU] Australia ..... PM0034

[51] Int. Cl.[6] ..... B65D 90/00

[52] U.S. Cl. ..... 220/529; 220/532; 220/909

[58] Field of Search ..... 220/529, 528, 220/532, 909

[56] References Cited

U.S. PATENT DOCUMENTS

| | | | |
|---|---|---|---|
| 2,700,521 | 1/1955 | Lapham | 220/529 X |
| 3,720,346 | 3/1973 | Cypher | 220/909 X |
| 4,130,153 | 12/1978 | Zopf | 220/529 X |
| 4,819,795 | 4/1989 | Swaney | 220/532 X |
| 5,072,852 | 12/1991 | Smith et al. | 220/909 X |
| 5,127,538 | 7/1992 | Bach | 220/529 |
| 5,150,809 | 9/1992 | Leigh | 220/529 X |

FOREIGN PATENT DOCUMENTS

| | | |
|---|---|---|
| 56920 | 8/1990 | Australia . |
| 86008 | 5/1992 | Australia . |
| 78335 | 8/1992 | Australia . |
| 15277 | 11/1992 | Australia . |

*Primary Examiner*—Steven M. Pollard
*Attorney, Agent, or Firm*—Loeb & Loeb LLP

[57] ABSTRACT

An insert assembly for a bin, the insert comprising a sleeve (10) which is insertable into the bin sad which can be positioned adjacent a bottom wall of the bin, the sleeve (10) including a first engaging means (12A, 12B); a bin dividing panel (11) insertable into the bin to divide the bin into a plurality of separate zones, the panel (11) being extendible from adjacent the bottom wall of the bin and being engageable with the first engaging means (12A, 12B) to prevent sideways movement of the panel in at least one direction in the bin; second engaging means (13A, 13B) in use being adjacent the mouth of the bin to hold the panel (11) against sideways movement in at least one direction, and, means (20A–21A, 20B–21B) to prevent the panel (11) from being removed from the bin upon emptying of the bin.

10 Claims, 2 Drawing Sheets

20A
20B
13A
13B
19
11
18
20
14d
16a
16b
12A
14c
16d
16c
10
16c
16d
12B
14a
14b
15

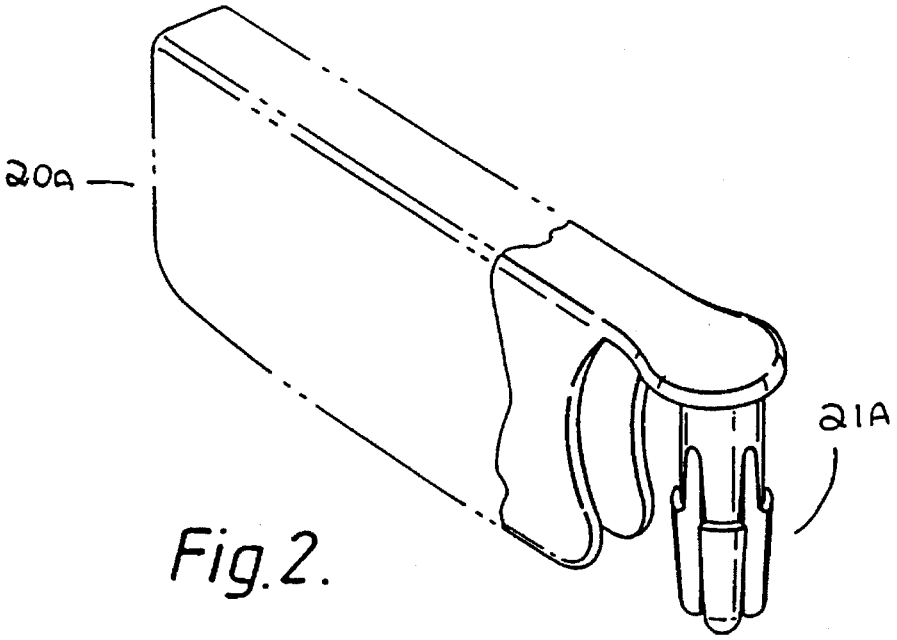
Fig. 2.
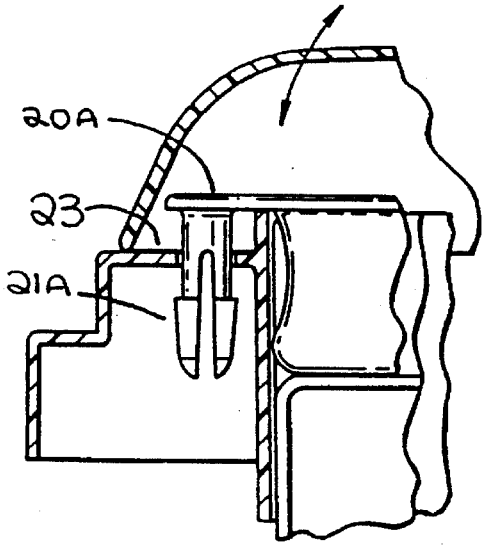
Fig. 3.
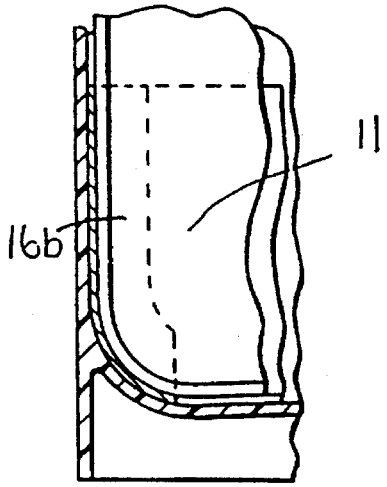

INSERT FOR A RUBBISH BIN

FIELD OF THE INVENTION

THIS INVENTION relates to an insert for a bin, and particularly relates to an insert which can be fitted to existing rubbish bins to divide the bin into separate compartments which can enable the bin to be used for recycling, and where the insert does not fall out when the bin is emptied.

BACKGROUND ART

Outside domestic rubbish bins commonly comprise "wheelie bins" which are large (usually 240–360 litre) plastic bins fitted with a hinged lid. The bin is mounted on a pair of wheels to allow it to be transported from the house (or other building) to the kerb side for emptying. The wheelie bins are emptied by a garbage truck which is fitted with an arm or hook which lifts the bin up, inverts the bin to empty the contents and vigorously shakes the bin to ensure that all the contents are removed.

Due to the reduction in available space to dump rubbish, and the ever higher costs in doing so, many local and state authorities now require that rubbish is recycled. This requires the rubbish to be separated into similar components such as glass, plastic, metal, paper products and the like. To maximise the efficiency of recycling, there are considerable advantages in having the householder initially sort the rubbish into recyclable portions, and then to place the portions into the rubbish bin in separate compartments.

A disadvantage with this is that there are millions of bins which have not been fitted with compartments, and it is uneconomical to destroy these bins for new bins. However, dividing the bin into compartments is not a simple matter. Attempts have beer made to attach a bracket to the inside of the bin and adjacent the bottom wall. The bracket could provide a support for a dividing wall in the bin. However, gluing such bracket to the bottom of the bin has not been successful as an adhesive with at least a five year life (the average life of a bin being 7 to 9 years) has not been found. The inside of a bin very often contains moisture, greases, mould and solvents and these are found to attack the adhesive. The plastic wall of the bin is also of a type to not readily accept an adhesive. The bin must also be spotlessly clean to maximise adhesion.

Attempts have also been made to rivet or otherwise fasten a bracket to the inside of the bin. However this requires careful alignment of the bracket which is not easy task when considering the length of the bin. Also, fastening generally requires a hole to be drilled through the bin bottom and this can result in seepage or oozing of liquids from the bin.

Another consideration with attaching a dividing wall inside a bin, is that the wall must be securely mounted, and must not fall out when the bin is emptied. As bins have to sustain rough handling and vigorous shaking when being emptied, it is important that the dividing compartment is securely held in place.

OBJECT OF THE INVENTION

The present invention has been developed to provide an insert assembly which can be fitted to rubbish bins and which can allow an internal divider to be easily fitted and securely held to the bin.

It is therefore an object of the invention to provide an insert assembly for a bin which may overcome the above-mentioned disadvantages or provide the consumer with a useful or commercial choice.

In one form, the invention resides in an insert assembly for a bin, the insert assembly comprising a sleeve which is insertable into the bin and which can be positioned adjacent a bottom wall of the bin, the sleeve including a first engaging means, a bin dividing panel insertable into the bin to divide the bin into a plurality of separate zones, the panel being extendible from adjacent the bottom wall of the bin and being engageable with the first engaging means to prevent sideways movement of the panel in at least one direction in the bin, second engaging means in use being adjacent the mouth of the bin to hold the panel against sideways movement in at least one direction, and, means to prevent the panel from being removed from the bin upon emptying of the bin.

The bins may comprise plastic bins which are usually 240 liters or more in volume, and which are being widely used for collecting and emptying rubbish.

The sleeve may be shaped to snugly fit within the bin and conform to the internal cross-section of the bottom wall of the bin, Thus, if the bottom wall of the bin is substantially rectangular, it is preferred that the sleeve is also substantially rectangular. By having the sleeve fitting snugly into the bottom of the bin, there is minimised the possibility of rubbish lodging between the sleeve and the wall of the bin. It can be appreciated that it may be necessary to provide a number of different sleeves depending on the particular type and size of bin. The sleeve may include side walls which may be joined together and preferably the sleeve does not include a bottom wall. The sleeve may be simply dropped into the bin without any need to secure it by fasteners, adhesive and the like.

The first engaging means may be provided on the side wall(s) of the sleeve. The engaging means may comprise a pair of ribs or flanges which are spaced apart by a distance corresponding to the thickness of the bin dividing panel. In this manner, the bin dividing panel may be positioned between the pair of ribs or flanges. A second pair of ribs or flanges may be provided on an opposite wall of the sleeve to accommodate the other side of the bin dividing panel. The first engaging means may be positioned such that the bin dividing panel divides the bin into two equal zones, or into unequal zones. It is preferred that a number of engaging means are provided to allow the bin dividing panel to be fitted in a number of positions thereby allowing the bin to be divided into various zones depending on the recycling needs. Suitably, each wall of the sleeve is provided with at least one engaging means.

The bin dividing panel may be substantially continuously formed, or may comprise a mesh, grid-like arrangement or other type of arrangement. Thus, for recycling large objects, the panel may be mesh or grid-shaped, while for recycling small objects, it may be preferred to have the panel being substantially solid. In order to minimise the thickness of the panel (which can reduce the effective internal volume of the bin), but also to provide the panel with sufficient rigidity, the panel may be formed with strengthening ribs, or have a configuration to provide it with sufficient rigidity.

Suitably, the panel extends from adjacent the bottom of the bin to adjacent the top of the bin such that when the lid of the bin is closed, the panel may almost touch the internal lid of the bin. This arrangement minimises the possibility of separated materials being mixed together.

The second engaging means may be located on an upper portion of the bin dividing panel, and may be engageable with an upper part of the bin. Suitably, the second engaging means comprises at least one clip which can be separately attached to the panel and also attached to the bin. The at least one clip may include a nose portion which can be pushed through an aperture in an external part of the bin thereby locking the panel to the bin. In this arrangement, the means to prevent the panel from being released from the bin comprises the second engaging means. However, the first engaging means may also comprise an arrangement to prevent the panel from being removed from the bin.

DESCRIPTION OF THE DRAWINGS

An embodiment of the invention will be described with reference to the following drawings in which

FIG. 2 shows detail of the second engaging means;

FIG. 3 is a section view of a bin containing the insert assembly according to FIG. 1.

BEST MODE

Figure 1:
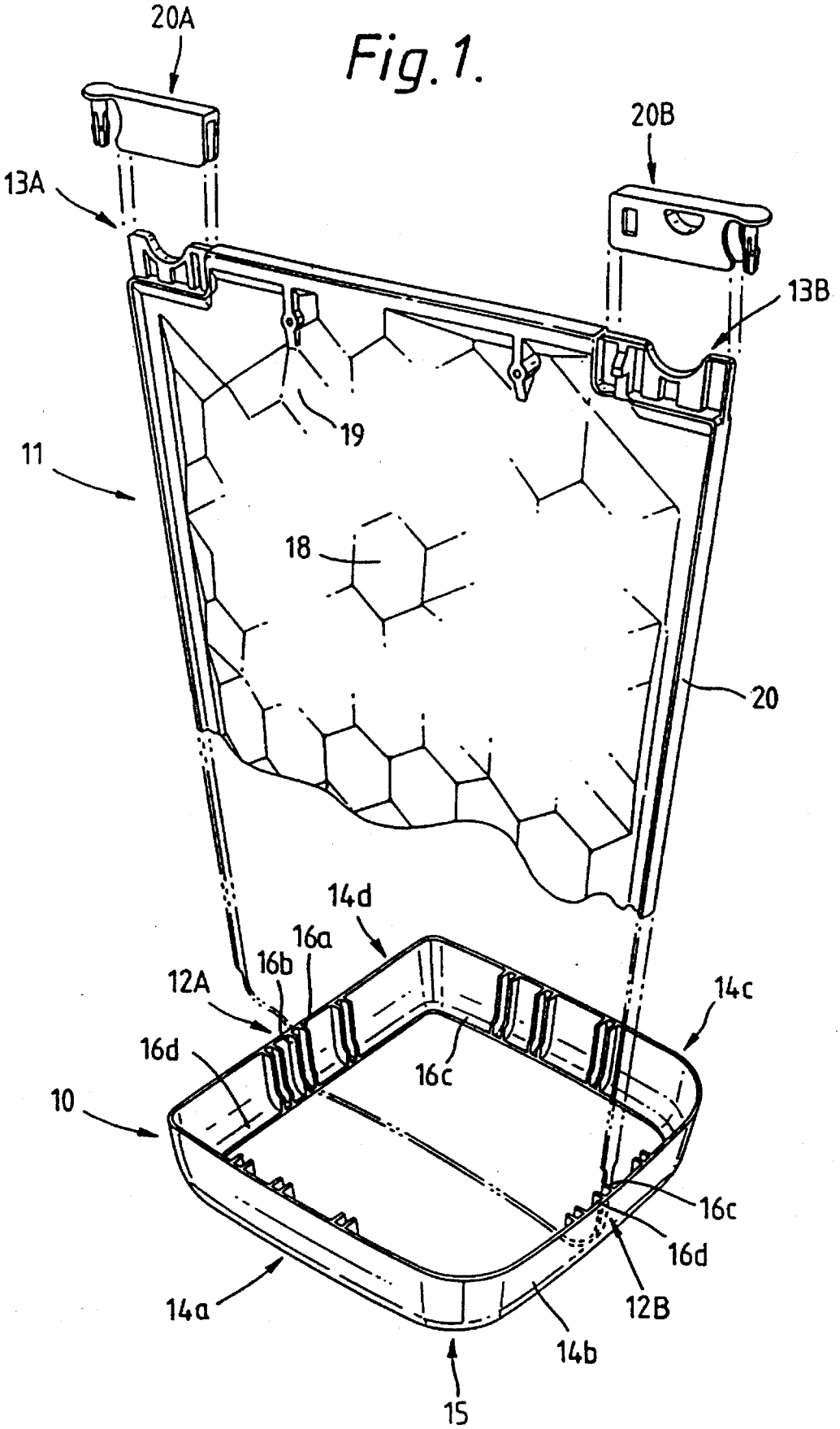
FIG. 1 shows the various components of an insert assembly according to an embodiment of the invention.

Referring to the figures, and particularly FIG. 1 there is illustrated an insert assembly for a bin. The insert assembly comprises a sleeve 10, bin dividing panel 11, first engaging means 12A, 12B and second engaging means 13A, 13B.

Sleeve 10 is substantially rectangular in shape when viewed in plan and is formed from injection moulded plastics material. The sleeve is formed from four substantially vertically extending side walls 14A–14D which are integrally Joined adjacent their longitudinal ends. The sleeve has rounded corners (e.g. 15) to conform with the particular internal shape of the bin. It should be appreciated that the shape of sleeve 10 will of course depend upon the shape of the internal walls of the bin. Sleeve 10 is configured such that it can be simply inserted into the open mouth of the bin and dropped down. The sleeve then ultimately falls to or can be positioned to fit against the bottom wall of the bin. The side walls 14A–14D then extend adjacent respective side walls of the bin. The sleeve is dimensioned to be a snug fit in the bin to prevent debris from lodging between a respective outer wall 14A–14D, and the wall of the bin. Each wall 14A–14D is tapered inwardly and includes a small horizontal peripheral lower lip 16A–16D (only 16C–16D illustrated in FIG. 1).

The first engaging means 12A, 12B is positioned on opposed side walls 14B–14D, and comprises pairs of spaced ribs 16A, 16B, 16C, 16D which extend vertically in use from adjacent an upper edge of the respective wall to adjacent the peripheral lip of the respective wall. Each rib is inwardly curved adjacent lower edge thereof as illustrated in FIG. 1. Ribs 16A–16B and 16C–16D are spaced apart and are positioned in a parallel relationship relative to each other. The spacing between the ribs corresponds to the thickness of the bin dividing panel 11 such that the panel can slide between a pair of ribs. This prevents the panel from sideways movement in both directions. In the illustration of FIG. 1, the ribs are positioned on the respective side wall such that the panel divides the bin into two substantially equal volumes. However, to allow the bin to be divided into non-equal volumes, further engagement means are provided on each wall. In this manner, the bin can be divided into a plurality of zones of different volumes, and indeed it is possible for more than one bin dividing panel to be inserted into the bin. The first engagement means is also positioned such the bin dividing panel 11 can either extend into a north-south manner, or an east-west manner. The position of the divider will depend to some extent on how the bin is emptied, and the sleeve allows for the various different orientations of the panel.

The bin dividing panel is formed from a sheet of plastic material. To minimise the thickness of the sheet (and thereby maximise the useable material volume of the bin), the panel has a single wall provided with an arrangement of concave and convex portions 18, 19, which provide rigidity to the panel without effectively increasing the non-useable volume in the bin. A peripheral strengthening rib 20 is provided around the side walls and the top wall of panel 11. Panel 11 is sized to extend from adjacent the bottom wall of the bin to adjacent the top wall of the bin and is also sized such that it fits snugly against the internal wall of the bin again to minimise the separated components from mixing together. The bottom area of panel 11 is of narrower length than the top end, due to the internal configuration of a bin. The narrower bottom portion of the bin is caused by the requirement to add an axle and wheels to the external body of the bin. The bottom end of panel 11 can be captured between a pair of adjacent ribs as illustrated in FIG. 1 to maintain the panel in a particular position in the bin. In the embodiment described, the ribs do not prevent the panel from being pulled out, but merely prevents the panel from moving sideways.

Adjacent an upper part of panel 11 is provided a second engaging means in the form of a pair of plastic clips 20A, 20B. Clips 20A, 20B are formed separately from panel 11 and can be snap-fitted to an upper edge of panel 11 and adjacent opposed longitudinal edges thereof. Clips 20A, 20B include a nose portion 21A, 21B which is of an "arrowhead" configuration. The nose portion can be manually pushed through a hole provided on a horizontal flange 23 extending around the bin. Once the arrowhead portion is pushed through the hole, the clips cannot be readily removed and this causes the bin dividing panel 11 to be retained within the bin even when the bin is emptied. The clips also prevent lateral movement of the panel 11 within the bin. The clips are positioned such that they lie within or underneath the lid of the bin when the lid is closed. Thus, the proper sealing of the lid is not affected by the positioning of the clips.

In use, an existing bin can be retrospectively fitted with the insert assembly according to the invention. The bin can be maintained in a upright position, and does not need to be made spotlessly clean (as is required with adhesives). The sleeve 10 can be simply dropped into the bin, and all that is required is that a pair of holes be drilled in the horizontal flange around an upper portion of the bin to accommodate the clips. The bin dividing panel can then be lowered into the bin and the clips can be snap-locked through the drilled holes which converts the bin to a bin which can be used for recycling purposes. The insert assembly does not require any holes to be drilled through the internal wall of the bin (thereby allowing seepage and odours to escape), does not require any separate fasteners to be aligned and attached, and does not require any gluing step to keep the bin dividing panel within the bin.

It should be appreciated that various other changes and modifications may be made to the embodiments as described without departing from the spirit and scope of the invention as claimed.

I claim:

1. An insert assembly for a bin, the insert assembly comprising a sleeve which is insertable into the bin and which can be positioned adjacent a bottom wall of the bin, the sleeve including a first engaging means; a bin dividing panel insertable into the bin to divide the bin into a plurality of separate zones, the panel being extendible from adjacent the bottom wall of the bin and being engageable with the first engaging means to prevent sideways movement of the panel in at least one direction in the bin; second engaging means in use being adjacent the mouth of the bin to hold the panel against sideways movement in at least one direction, and, means to prevent the panel from being removed from the bin upon emptying of the bin.

2. The insert assembly of claim 1, wherein a plurality of first engaging means are provided on the sleeve.

3. The insert assembly of claim 2, wherein the engaging means comprises a pair of ribs which are spaced apart by a distance corresponding to the thickness of the bin dividing panel, the ribs being on opposed side walls of the sleeve.

4. The insert assembly of claim 3, wherein the engaging means are provided on each side wall of the sleeve to allow the bin dividing panel to adopt various positions in the bin.

5. The insert assembly of claim 4, wherein the bin dividing panel is substantially planar and is sized to extend from adjacent a bottom wall of the bin to adjacent an upper inlet of the bin.

6. The insert assembly of claim 5, wherein the second engaging means comprises at least one clip attachable to an upper portion of the bin dividing panel and to an upper portion of the bin.

7. The insert assembly of claim 6, wherein a pair of said clips are provided adjacent opposed upper edges of the bin dividing panel.

8. The insert assembly of claim 7, wherein the clips include nose portions which are configured to allow the nose portions to be pressed locked through an opening provided in an upper external portion of the bin, the clips thereby comprising the means to prevent the panel from being removed from the bin upon emptying of the bin.

9. The insert assembly as claimed in claim 8, wherein the bin includes a hinged lid overlying the mouth of the bin, the clips being located within the lid when the lid is in its closed position.

10. A bin containing the assembly of claim 1.

* * * * *